US005662484A

United States Patent [19]

Blanche

[11] Patent Number: 5,662,484

[45] Date of Patent: Sep. 2, 1997

[54] BRIDGED ELECTRICAL PLUG

[75] Inventor: Stephen A. Blanche, Warwick, R.I.

[73] Assignee: ETCO Incorporated, Warwick, R.I.

[21] Appl. No.: 522,018

[22] Filed: Aug. 31, 1995

[51] Int. Cl.[6] ..... H01R 19/00

[52] U.S. Cl. ..... 439/106; 439/606

[58] Field of Search ..... 439/106, 606, 439/695, 736

[56] References Cited

U.S. PATENT DOCUMENTS

| | | | |
|---|---|---|---|
| 2,861,324 | 11/1958 | Klumpp, Jr. | 439/106 |
| 4,718,865 | 1/1988 | Cordeiro | 439/606 |
| 4,771,538 | 9/1988 | O'Loughlin et al. | 29/874 |
| 5,171,168 | 12/1992 | Chiodo | 439/651 |
| 5,378,162 | 1/1995 | Waible | 439/106 |
| 5,411,403 | 5/1995 | Blanche | 439/106 |

FOREIGN PATENT DOCUMENTS

| | | |
|---|---|---|
| 0144128 | 6/1985 | European Pat. Off. . |
| 0239409 | 9/1925 | United Kingdom . |
| 0979514 | 1/1965 | United Kingdom . |

*Primary Examiner*—Neil Abrams
*Assistant Examiner*—Eugene G. Byrd

[57] ABSTRACT

A bridged electrical plug in which blade elements have integral cup-like and blade contact portions and an intermediate neck twisted to bring openings of the cup-like portions into transversely spaced parallel directions.

7 Claims, 1 Drawing Sheet

BRIDGED ELECTRICAL PLUG

FIELD OF THE INVENTION

This invention relates to electrical plugs, and more particularly to bridged electrical plugs in which contact portions are given new and improved interrelations with bridges thereof.

BACKGROUND OF THE INVENTION

Plugs with two power blades and a ground plug are known in the prior art, as are also the disclosures of my U.S. Pat. No. 5,411,403, "Bridged Electrical Plug", granted May 2, 1995, hereby incorporated by reference herein.

Also known in the art are plugs with two blade contacts and a ground contact each integral with wire-receiving cup-shaped contact portions non-overlappingly facing in different directions, with blade contact portions bent double and formed with a longitudinally retaining set of abutments at a bridge, and plugs with such three cup-shaped contact portions facing in transversely spaced parallel directions but not integral with blade or ground contact portions.

SUMMARY OF THE INVENTION

My new plug provides not only for easy and cheap manufacture, in an automated way, but desirable insulative qualities as well.

It features inclusion in the plug of one or more contact elements with a contact end portion in twisted relation to an integral blade contact portion longitudinally spaced therefrom. In another aspect, it features a plurality of blade contact elements in which open contact end portions are provided with openings that face in the parallel transverse directions the projections of said end portions along such parallel directions not overlapping.

PREFERRED EMBODIMENT

Following is a description of the presently preferred embodiment, shown in the drawings, of the invention.

Figure 1:
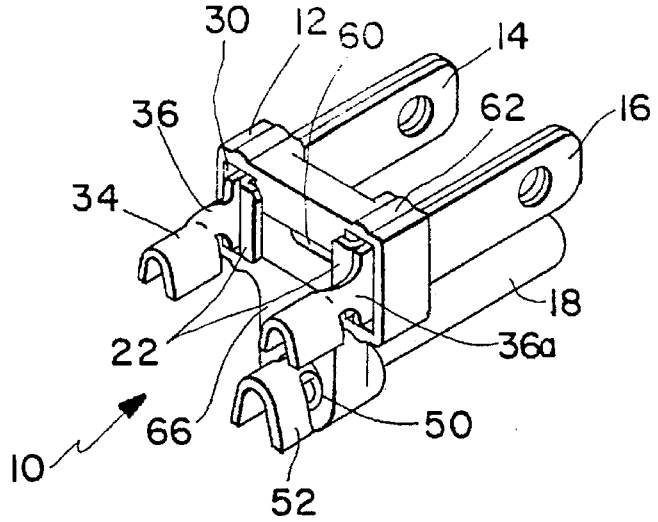
FIG. 1 is an isometric drawing of that embodiment.
Figure 2:
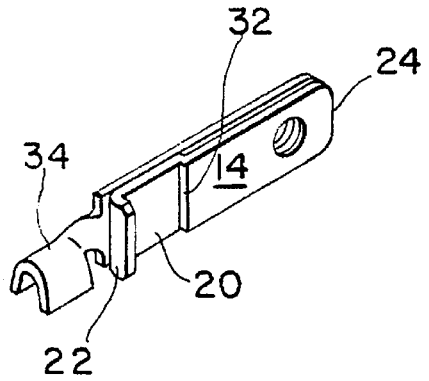
FIG. 2 is an isometric view of one of the blade elements of the FIG. 1 assembly.
Figure 3:
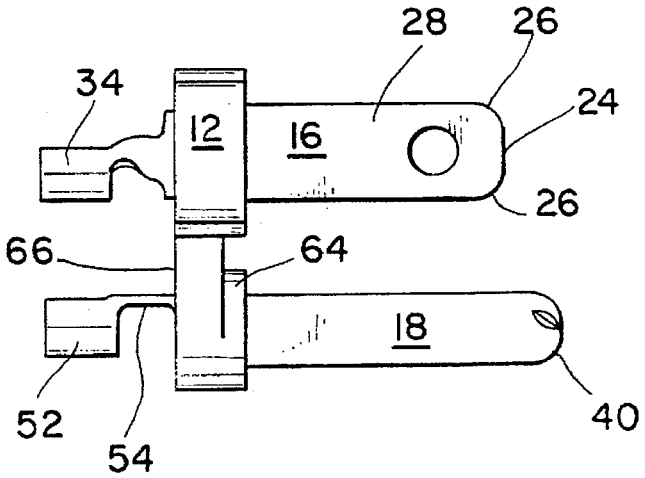
FIG. 3 is a side elevation view of the assembly.

Shown in FIG. 1 is an electrical plug assembly indicated generally at 10.

An injection molded rigid polyvinyl chloride bridge 12 holds a first blade contact element 14 and a second blade contact element 16, as well as a conventional closed-end ground contact tube 18.

Contact element 14 is made by cutting from brass sheet an appropriate shape, following which the offset portion 20 and abutment 22 are formed in the sheet and it is bent on itself at 24, where it remains integral between the arcs 26. The doubled blade 28 extends through rectangular hole 30 extending through the thickness of bridge 12, and is secured against undue longitudinal movement by abutment 22 and step 32 which define therebetween portion 20, at which housing 12 is maintained. Metal forming is used also to produce the cup-shaped contact portion 34, and to twist its neck 36 counterclockwise (viewing the element 14 in end elevation from the end of contact 34) 90 degrees, to make the concavity of contact 34 face squarely downward in the figures.

Contact element 16 is identical, except that its abutment 22 faces in the opposite direction, so that the two abutments 22 extend toward each other; and that the final 90 degree twist of its neck **36*a* is thus in an opposite rotative direction relative to the blade portion with which it is integral (although still rotated counterclockwise relative to the mounted blade element 16, because that is itself rotated 180 degrees about its longitudinal axis from blade element 14**).

The twisting of necks 36 and **36*a*** give desirable work hardening of the metal.

Ground element 18 is formed conventionally from a brass sheet cutout almost closed at its end 40, and is force fitted in hole 50 of bridge 12. Its contact portion 52 faces in a direction parallel to those for elements 14 and 16 (i.e., the three planes bisecting the three contact cups 34, 52 are parallel and transversely spaced, that for cup 52 being halfway between the other two), although its neck 54 is untwisted.

The completed plug assembly is finally encapsulated in an integral injection molding of conventional plastic, shaped with a flat surface perpendicular to elements 14, 16, 18 and just back of bridge 12, and a cylindrical surface forward thereof and merging into a semispherical front outer surface, this plastic encapsulation encompassing cups 34, 52 and the lead wires crimped into them (so that they are no longer cup-shaped), not shown.

Holes 30 and 60 through bridge 12, as well as ridges 62 and cylindrical protrusion 64, and another (rectangular) hole (not shown) extending through flange 66 of bridge 12, centrally thereof and vertically located between hole 60 and contact portion 62, aid encapsulation structurally, as well as saving plastic material.

Orienting the cup-like contact portions 34 along parallel transversely spaced directions, as illustrated in FIG. 1, in which the centerlines of the two blade contact elements 14, 16 are transversely equidistant from the vertical centerline of bridge 12, facilitates simultaneous movement of three parallel contact wire bundles along parallel directions generally perpendicular to their axes (upwardly, in the figures) into the open portions of cup-shaped contacts 34.

The configuration and arrangement of the invention is otherwise also well suited for automatic production.

OTHER EMBODIMENTS

Other embodiments within the claims will occur to those in the art.

What is claimed is:

1. A plug assembly comprising an integral contact blade element, said element including a contact blade portion as one end, a second contact portion toward a second end, and a neck intermediate thereof, said neck being twisted relative to said blade portion, said second contact portion being at said second end, and said neck being adjacent each said portion and twisted 90 degrees, and a bridge carrying said bridge element and a second contact element, in which each said second contact portion is generally cup-shaped to accept a wire through an opening into said portion.

2. The plug assembly of claim 1 in which said openings are in parallel directions.

3. The plug assembly of claim 2 in which said second contact portion is at said second end and said neck is adjacent each said portion, and said second contact element is like said first contact element except that each neck is twisted 90 degrees in an opposite angular direction.

4. The plug assembly of claim 3 which includes also an integral ground contact element, said ground contact element including a third contact portion at a third end away from a cylindrical end thereof.

5. The plug assembly of claim 4 in which said third contact portion is generally cup-shaped to accept a wire through an opening into said portion.

6. The plug assembly of claim 5 in which all said openings are along parallel transversely spaced directions.

7. A plug comprising the plug assembly of claim 6 in which the cup-like portions are crimped around wires and said plug assembly is encapsulated in plastic.

* * * * *